US012122581B2

(12) United States Patent
Wendt et al.

(10) Patent No.: US 12,122,581 B2
(45) Date of Patent: Oct. 22, 2024

(54) PACK FOR CERAMIC BLADES

(71) Applicant: MARTOR KG, Solingen (DE)

(72) Inventors: Sylke Wendt, Solingen (DE); Kerry Henn, Solingen (DE); Julian Soult, Herdecke (DE)

(73) Assignee: MARTOR KG, Solingen (DE)

( * ) Notice: Subject to any disclaimer, the term of this patent is extended or adjusted under 35 U.S.C. 154(b) by 169 days.

(21) Appl. No.: 17/774,142

(22) PCT Filed: Nov. 3, 2020

(86) PCT No.: PCT/EP2020/080804
§ 371 (c)(1),
(2) Date: May 3, 2022

(87) PCT Pub. No.: WO2021/089537
PCT Pub. Date: May 14, 2021

(65) Prior Publication Data

US 2023/0002134 A1 Jan. 5, 2023

(30) Foreign Application Priority Data

Nov. 4, 2019 (DE) ..... 10 2019 129 599.8

(51) Int. Cl.
*B65D 73/00* (2006.01)
*B65D 75/30* (2006.01)
*B65D 83/10* (2006.01)

(52) U.S. Cl.
CPC ..... *B65D 73/0085* (2013.01); *B65D 75/30* (2013.01); *B65D 83/10* (2013.01); *B65D 2575/565* (2013.01); *B65D 2583/082* (2013.01)

(58) Field of Classification Search
CPC ..... B65D 75/366; B65D 75/36; B65D 75/00; B65D 83/10; B65D 75/327; B65D 83/00
(Continued)

(56) References Cited

U.S. PATENT DOCUMENTS 1,489,379 A 4/1924 Zeller
1,863,074 A * 6/1932 Swan ..... B65D 83/10 206/354
(Continued)

FOREIGN PATENT DOCUMENTS

DE 102008015079 A1 10/2009
DE 202007019086 U1 8/2010
(Continued)

OTHER PUBLICATIONS

European Patent Office. International Search Report and Written Opinion. Issued in Application No. PCT/EP2020/080804 on Mar. 12, 2021. 21 pages, including English translation of International Search Report.

*Primary Examiner* — Steven A. Reynolds
*Assistant Examiner* — Prince Pal
(74) *Attorney, Agent, or Firm* — Meunier Carlin & Curfman LLC

(57) ABSTRACT

Disclosed herein are packagings for cutting blades, multiple packagings connected to each other, methods for using and producing such packagings, and a method for packaging cutting blades in such packagings. One such packaging comprises a substantially flat base and cover layer made of a first and a second packaging material respectively, a blade receptacle between the two layers, and a cover of the blade receptacle formed in the cover layer. The first and second packaging material are made primarily of cardboard. The packaging materials each have a first and a second rigidity in corresponding primary directions, wherein a cutting edge of a blade is disposed in the packaging parallel to at least one of the primary directions. A multiple packaging made of such individual packagings with a separation region between two individual packagings comprises a planned parting line in a layer and a hinge line in the other layer.

17 Claims, 7 Drawing Sheets

(58) Field of Classification Search
USPC ..... 206/354, 352, 353, 359, 355, 346, 380, 206/461, 462, 471, 349
See application file for complete search history.

(56) References Cited

U.S. PATENT DOCUMENTS 1,899,979 A * 3/1933 Noyes ..... B65D 83/10 30/40.2
1,936,076 A * 11/1933 Unsinger ..... B65D 83/10 206/353
2,014,977 A * 9/1935 Muros ..... B65D 83/10 30/40.2
2,058,147 A * 10/1936 Gustafson ..... B65B 25/003 53/157
2,158,049 A * 5/1939 O'Brien ..... A45D 27/24 206/353
2,239,145 A * 4/1941 Doner ..... G09F 5/042 206/232
3,279,596 A * 10/1966 Prym ..... B65D 75/366 206/469
3,358,820 A * 12/1967 Fairbairn ..... B65D 5/32 206/518
3,666,087 A * 5/1972 Cooper ..... B65D 75/327 220/837
3,970,194 A 7/1976 Iten
3,972,417 A * 8/1976 Iten ..... B65D 75/366 206/493
4,095,691 A * 6/1978 Iten ..... B65D 75/30 229/245
4,408,691 A * 10/1983 Takahashi ..... B65D 85/24 206/382
4,413,727 A * 11/1983 Cerwin ..... A61B 17/06138 206/380
4,445,610 A * 5/1984 Richards ..... B65D 73/0085 206/349
4,739,883 A * 4/1988 Mohs ..... B65D 73/00 206/467
4,819,804 A * 4/1989 Levy ..... B65D 85/48 206/456
4,981,212 A * 1/1991 Lutz ..... B65D 73/0057 206/355
5,265,759 A * 11/1993 Coffin ..... B65D 5/4204 221/312 A
5,611,433 A * 3/1997 Levy ..... B01L 3/5055 206/569
5,975,302 A * 11/1999 Young ..... G09F 3/20 206/39
6,006,911 A 12/1999 Levy
6,588,591 B1 7/2003 Schabert et al.
7,798,324 B2 * 9/2010 Wojcik ..... B65B 9/045 206/349
8,181,789 B1 * 5/2012 Casella ..... B65D 77/0413 206/39.7
9,211,988 B2 * 12/2015 Jensen ..... B65D 75/30
9,827,741 B2 * 11/2017 Glinert ..... B32B 29/08
10,315,805 B1 * 6/2019 Wilson ..... B65D 81/03
10,457,459 B2 * 10/2019 Vorobej ..... B65D 75/24
11,225,359 B2 * 1/2022 Makofsky ..... A45D 27/22
2002/0069619 A1 * 6/2002 Abasolo ..... C12M 45/22 53/469
2003/0183551 A1 * 10/2003 Hulick ..... B65D 83/0463 206/532
2004/0026489 A1 * 2/2004 Hodsdon ..... B65D 27/00 229/92.8
2004/0206640 A1 * 10/2004 Frenkel ..... B42D 15/042 206/232
2005/0274048 A1 * 12/2005 Gerrie ..... B65D 27/04 40/124.06
2006/0283729 A1 * 12/2006 Feffer ..... G11B 33/0422 229/87.01
2007/0051652 A1 * 3/2007 Tilton ..... B65D 73/0092 206/457
2008/0023352 A1 * 1/2008 Creed ..... B65D 73/0078 206/440
2010/0288669 A1 * 11/2010 Arndt ..... B65D 83/0463 206/462
2011/0100845 A1 * 5/2011 Meech ..... B65D 75/366 206/349
2012/0292206 A1 * 11/2012 Casella ..... B65D 73/0085 206/232
2013/0248406 A1 * 9/2013 Glinert ..... B65B 47/00 53/415
2016/0137383 A1 * 5/2016 Wetsch ..... B29C 65/48 206/522
2018/0162597 A1 * 6/2018 Jobe ..... B65D 81/03
2020/0189797 A1 * 6/2020 Makofsky ..... B65D 5/4204
2020/0189798 A1 * 6/2020 Makofsky ..... B65D 5/4204
2023/0312207 A1 * 10/2023 Deliou ..... B65D 75/38 206/461

FOREIGN PATENT DOCUMENTS

DE 102010025517 A1 10/2011
EP 0260345 A2 3/1988
EP 0922651 B1 3/2003
EP 1968868 B1 6/2015

* cited by examiner

PACK FOR CERAMIC BLADES

CROSS REFERENCE TO RELATED APPLICATIONS

This application is a national stage application filed under 35 U.S.C. § 371 of PCT/EP2020/080804 filed Nov. 3, 2020, which claims priority to and benefit of German application serial number 102019129599.8 filed Nov. 4, 2019, which is fully incorporated by reference and made a part hereof.

The present invention relates to packagings for cutting blades, multiple packagings made of a plurality of packagings connected to each other for cutting blades, a method for packaging cutting blades, and a method for producing a multiple packaging made of a plurality of packagings connected to each other.

For operating cutting devices comprising an interchangeable cutting blade, the user is required to supply cutting blades. Said cutting blades require suitable packaging for sales, storage, and transport. Various requirements for designing and producing the packaging are thereby presented by sales, storage, and transport, as well as by the production and disposal of packaging and cutting blades.

A flexible packaging for cutting blades is known from the German utility patent specification DE 20 2007 019 086 U1, comprising a flexible first layer having at least one hollow space formed therein and forming a basis for receiving a cutting blade, a flexible second layer disposed over the base, and a seal, wherein the seal is implemented about the circumference of each hollow space in order to encapsulate a cutting blade disposed in the hollow space.

Methods for producing a packaging and packaging strips are disclosed in the European patent specification EP 1 968 868 B1. The methods disclosed therein comprise attaching a first layer to a second layer in order to produce a connected region comprising a removable seal. Perforation cuts are provided through the first layer. A cut running transversely is provided through both the first and the second layer, wherein the cut running transversely crosses the perforation cut at least once in order to produce a segment forming a flap.

European patent specification EP 0 922 651 B1 discloses reclosable, dust-protected packagings comprising a front side wall and a rear side wall disposed overlapping each other.

The German patent specification DE 10 2008 015 079 A1 discloses multiple packagings for two or more contents separated from each other, each present in a casing comprising a hollow space. Two adjacent casings are connected by means of a common edge of two or more areas of each casing abutting each other at an angle.

The European patent specification EP 0 260 345 A2 discloses packaging units having a plurality of folding boxes and a method for producing packaging units having a plurality of folding boxes.

The object of the present invention is to provide an improved packaging for cutting blades, particularly for better fulfilling the various requirements from sales, storage, transport, production, and disposal of packaging and cutting blades. A further object of the present invention is to provide associated methods for packaging cutting blades and for producing multiple packagings made of a plurality of packagings connected to each other for cutting blades.

The object of the invention is achieved for a first consideration by a packaging for cutting blades comprising a substantially flat base layer made of a first packaging material and a substantially flat cover layer made of a second packaging material, the cover layer being disposed on a top side of the base layer and connected to the base layer at least in segments. The base layer comprises a blade receptacle designed for receiving a single cutting blade. A segment of the cover layer forms a cover of the blade receptacle, the cover being releasable in order to expose a single cutting blade received by the blade receptacle. The first packaging material and the second packaging material are made primarily of cardboard.

In other words, the first and second packaging materials are each a material having a mass and/or volume content of cardboard of greater than half of the total volume and/or the total mass thereof. The first and second packaging material can particularly be made of 50% or greater, 60% or greater, 70% or greater, 80% or greater, particularly preferably 90% or greater, further preferably 95% or greater of cardboard, relative to the total volume and/or the total mass of the corresponding packaging material in each case. The proportion of each packaging material not made of cardboard is thereby preferably formed by various filler and/or additive substances, individually or in conjunction with each other, selected according to the concrete application. The filler and/or additive substances are thereby preferably selected in order to advantageously influence a property of the corresponding packaging material. In a further advantageous embodiment, the surface of the first and second packaging material, or the cardboard used therein, preferably comprise markings, particularly in the form of printing.

The cardboard of the first packaging material and of the second packaging material according to the first consideration of the invention is thereby preferably produced by means of arbitrary production methods selected according to the concrete application. It is particularly preferable that the production method for the first packaging material and the production method for the second packaging material are identical. Alternatively, different production methods for the first and second packaging materials are preferable. The cardboard of the first packaging material and/or of the second packaging material is particularly preferably solid cardboard, corrugated cardboard, or an arbitrary combination of solid and corrugated cardboard. It is preferable that the first and/or the second packaging material form a multilayer composite made of a plurality of identical or different layers of cardboard.

In an advantageous embodiment, a first starting material on which the production process for the first packaging material and/or the second packaging material is based is predominantly or entirely a recycled material, particularly recycled cardboard. In a particularly advantageous embodiment, a first starting material on which the production process for the first packaging material and/or the second packaging material is based is partially, predominantly, or entirely a cellulose obtained from certified sustainable sources. In a further, particularly advantageous embodiment, the first starting material made of recycling material can be combined with the second starting material made of cellulose from certified sustainable sources at arbitrary ratios.

The base layer and the cover layer are substantially flat, that is, said layers have a length and width extending in a plane. Said plane is preferably planar. Alternatively, it is preferable if the plane is curved in one or both directions defining the plane. The base layer and cover layer each have a thickness perpendicular to the corresponding plane of the length and width, wherein the corresponding thickness is substantially less than the corresponding length and corresponding width. The corresponding thickness is particularly 20% or less, 15% or less, 10% or less than the corresponding length and width of the base layer or cover layer. The connection between the base layer and cover layer at least in segments can be made by means of arbitrary, suitable means, preferably coordinated with the packaging materials used. The base layer and the cover layer are preferably glued, welded, pressed, connected by means of joining elements, and/or combinations thereof at a connecting segment. It is further preferable if the connecting segment connects a back side of the cover layer to a top side of the base layer in a flat manner.

The packaging preferably comprises a rectangular shape, wherein the length and width thereof can particularly correspond to a credit card format. It is further preferable that the length and width of the base layer correspond to the length and width of the cover layer.

In a further or alternatively preferred embodiment, the segment of the cover layer forming the cover is a partial segment of the cover layer. Alternatively or particularly preferably, the cover layer comprises a first partial segment forming the cover and a second partial segment set up for remaining connected to the base layer after the cover is removed.

A packaging according to the first consideration of the invention is particularly advantageous, as the use of cardboard in the packaging material facilitates disposing of and recycling of the packaging.

In a preferred embodiment of the packaging according to the first consideration of the invention, the blade receptacle is designed for limiting a displacement, at least in one plane parallel to the base layer, of an individual cutting blade received by the blade receptacle. The displacement of a cutting blade can thereby be limited by the blade receptacle to a dimension making it impossible or at least sufficiently improbable that a cutting blade received in the packaging will be damaged during transport and handling of the packaging. The blade receptacle is preferably designed for completely preventing displacement of a single cutting blade received therein. Arbitrary known means for producing a form fit or force fit between the blade receptacle and the cutting blade can be considered to this end, particularly by means of form-fit elements, undercuts, adhesive layers, and/or anchoring elements and clamping elements or segments.

The above disclosed refinements and features of the packaging according to the first consideration of the invention can be applied separately to all further considerations of the invention comprising identical or similar features and/or preferable refinements, without necessarily applying the other features of the first consideration of the invention as well. In this respect, reference is made in full to the above description for the following embodiments as well, wherein concrete embodiment examples can also be found in the description of the figures.

According to a second consideration of the invention, optionally implementing a preferred refinement of the packaging of the first consideration, a packaging is provided comprising a substantially flat base layer made of a first packaging material and a substantially flat cover layer made of a second packaging material, the cover layer being disposed on a top side of the base layer and connected to the base layer at least in segments. The base layer comprises a blade receptacle designed for receiving a single cutting blade, so that a cutting edge of a received cutting blade comprises a blade orientation specified by the blade receptacle. The first packaging material comprises at least a first rigidity along a first primary material direction and a second rigidity along a second primary material direction. The base layer and/or the cover layer is disposed so that the first primary material direction is aligned parallel to the blade orientation. Alternatively or in combination, the second packaging material comprises at least a third rigidity along a third primary material direction and a fourth rigidity along a fourth primary material direction. The base layer and/or the cover layer is disposed so that the third primary material direction is aligned parallel to the blade orientation. Alternatively, the base layer and/or cover layer can be disposed so that the second and/or fourth primary material direction is parallel to the blade orientation.

In a preferred embodiment, the first rigidity is greater than the second rigidity. In an alternative embodiment or a refinement, the third rigidity is greater than the fourth rigidity. Alternatively, the first and second rigidity can be equal and the third and fourth rigidity can be equal. In a further alternative, the first, second, third, and fourth rigidity are equal.

In a further preferred embodiment, the first and/or the second packaging material comprises a further rigidity along a further primary direction in each case. The corresponding primary directions of one of the two packaging materials can thereby particularly be perpendicular to each other. In a further refinement of the second consideration of the invention, the first and second and the third and fourth primary directions are thereby in a plane extending parallel to the base layer and the cover layer.

Because a first primary material direction is parallel to the blade orientation, the bending behavior of the packaging can be adapted according to the requirements of the cutting blade for a preferred handling. In an embodiment example, a long, thin cutting blade, thereby being very flexible, can be received in the blade receptacle. Depending on the application, it can be advantageous that the packaging prevents flexing of the long, thin cutting blade. In such a case, the first rigidity of the first packaging material is preferably adapted to be greater than the second rigidity of the first packaging, whereby bending of the packaging in the longitudinal direction of the cutting blade is made more difficult. In a further advantageous refinement, a third primary material direction of the second packaging material can also be aligned parallel to the blade orientation, wherein the third rigidity is greater than the fourth rigidity. If desired, the reinforcing effect can thereby be further reinforced by the alignment of the first primary material direction. As is explained by the present embodiment example, the primary material directions of the first and/or second packaging materials can be aligned in an arbitrary manner in order to achieve a desired rigidity behavior of the packaging. For example, it can also be desirable to set the rigidity of the base layer, of the cover layer, and/or of the entire packaging so that bending of the packaging, including the blade received therein, is facilitated in a direction parallel or transverse to the cutting edge.

In a preferred embodiment of the packaging of the second consideration, the first and/or the second packaging material is a corrugated cardboard, the corrugation direction thereof corresponding to the first and/or third primary material direction. Said preferred embodiment is based on the idea that the flexural rigidity of corrugated cardboard is greater transverse to the corrugation direction than along the corrugation direction. In an alternative, preferred refinement of the second consideration, the corrugation direction of the corrugated cardboard used corresponds to the second and/or third primary material direction. As is evident from the above explanations, any suitable material having anisotropic rigidity can be used as the first and/or second packaging material as a substitute for corrugated cardboard or in addition to the corrugated cardboard used. The use of plastics is thereby particularly conceivable, particularly having undergone orienting of the polymer chains present therein due to corresponding drawing, rolling, or casting processes before, during, and after the production thereof. It is further conceivable to provide a desired anisotropy to an isotropic material by introducing reinforcing materials, such as fibers.

The blade receptacle of the first and second considerations of the invention can optionally be provided on or in the base layer as a separate element, or by machining the base layer. In a preferred embodiment, the blade receptacle is implemented by a recess in the base layer.

In a further preferred embodiment, optionally of the first or second consideration of the invention, the recess has an inner contour corresponding at least in segments to the outer contour of an individual cutting blade. For example, a form fit can be produced between the blade receptacle and a cutting blade received in the blade receptacle for limiting or completely preventing displacing of the cutting blade at least in the plane of the base layer.

In a further preferred embodiment, optionally of the first or second consideration of the invention, the packaging further comprises a substantially flat substrate made of a third packaging material applied to the back side of the base layer. The third packaging material can be different from or identical to the first and/or the second packaging material and can comprise any property and any feature, in isolation or in combination, disclosed with respect to the first and the second packaging material. In this respect, reference is made to the above description for advantages and refinements. Applying the substrate can particularly take place in the same manner as connecting the base layer and the cover layer. Alternatively or in addition, a different, suitable connection can be selection. The base layer and substrate can particularly be glued to each other flatly and thus substantially integral in design, so that said layers form an integral, two-layer composite. For example, a substrate can be advantageous in order to further reinforce the packaging, to dispose a plurality of packagings on a continuous substrate, or to achieve an appearance of the packaging attractive to the user.

In a further preferred embodiment, optionally of the first or second consideration of the invention, part of the blade receptacle is formed by a pass-through opening in the base layer extending from the top side to a back side of the base layer. A substrate preferably applied to the back side of the blade receptacle then preferably forms a back wall of the blade receptacle. Such a three-layer packaging can provide advantages when producing the packaging. It can thus be possible, when the pass-through opening is produced in the base layer by means of a punching process, to subsequently complete the blade receptacle by applying the substrate to the back side of the base layer. Such producing in separate steps can simplify the production process and thus make said process less expensive.

In a further preferred embodiment, optionally of the first or of the second consideration of the invention, the packaging further comprises a profiled cutout designed for hanging the packaging on a corresponding counterpart of a storage facility. In a preferred refinement, the packaging further comprises tear-off region, wherein the profiled cutout is disposed in the tear-off region. The tear-off region is disposed in a segment of the base layer, the cover layer, and/or the substrate, wherein the tear-off region is bounded from the other packaging by a perforation along which the tear-off region can be tom off. By hanging up the packaging at a corresponding storage facility by means of the profiled cutout, the storage of the packaging and further the access to the stored packaging can be facilitated, for example in a salesroom. The profiled cutout particularly has the shape of a Euro perforation. For the case that the profiled cutout, complete with a tear-off region, can be tom off, said tearing off can advantageously facilitate the handling after purchase, for example. It can thus be possible for a customer to remove the tear-off region, when the profiled cutout is no longer needed after the purchase, and thus reduce the storage space required by the packaging.

In a further preferred embodiment, optionally of the first or of the second consideration of the invention, the substrate and the cover layer are implemented integrally and connected to each other by means of an intermediate segment. This is preferably achieved in that a substrate is divided into two regions by an intermediate segment, a first region remaining as the substrate and a second region implemented toward the substrate. The base layer is disposed between the substrate and the cover layer. The second region is thereby preferably folded over by about 180° along the intermediate segment, for example formed by a folded edge in the substrate, until said region makes contact on the base layer. Such a packaging can be advantageous because the quantity of semi-finished goods required for producing the same is further reduced. In a further preferred embodiment, optionally of the first or of the second consideration of the invention, the base layer and the cover layer are implemented integrally and connected to each other by means of an intermediate segment. Producing such a packaging preferably occurs in an analogous manner, as described above with respect to the packaging wherein the substrate and the cover layer are implemented integrally, wherein said embodiment can provide analogous advantages. A substrate is optionally mounted under the base layer.

In a further, preferred embodiment, the substrate, base layer, and cover layer are implemented integrally. A first intermediate segment connects the substrate and base layer, while a second intermediate segment connects the base layer and cover layer.

Reference is made to the figure description for further explanation of the present embodiment.

In a further preferred embodiment, optionally of the first or of the second consideration of the invention, a tear line is provided in the cover layer and limits, at least in segments, the segment of the cover layer forming the cover. It is particularly preferable that the tear line is a perforation enabling the cover to be removed from the cover layer, and thus providing access to the blade receptacle. It is further preferable that the segment of the cover layer forming the cover is completely surrounded by the tear line, whereby the cover can be completely separated from the packaging. Alternatively, the tear line can only partially surround the segment forming the cover. A segment of the edge of the cover is thus cut out by the tear line. Said cut out segment can be connected to the cover layer; in this case, the cut-out segment can form a hinge line when the tear line is separated. It can thereby be made possible to fold the cover open and closed. Alternatively, the cut-out segment is disposed on the edge of the packaging, whereby said region is implemented as a flap, for example, in order to facilitate grasping the cover. The contour of the cut-out segment at the edge of the cover can thereby take on any arbitrary shape enabling or supporting the function as a hinge line or alternatively as a flap, particularly such shapes as explained in the figures and the figure descriptions.

In a further preferred embodiment, optionally of the first or of the second consideration of the invention, a back side of the cover layer and the top side of the base layer are at least connected to each other at least one connecting segment, wherein the at least one connecting segment is disposed in a region of the cover layer outside of the cover. Said arrangement can facilitate removing the cover, as the user thereby need only cut through the tear line, but need not expend any further effort for overcoming the connecting segment.

In a further advantageous consideration, it can thereby be avoided that the connection between the base layer and cover layer is also removed unintentionally when removing the cover.

The above disclosed refinements and features of the packaging according to the second consideration of the invention can be applied separately to all further considerations of the invention comprising identical or similar features and/or preferable refinements, without necessarily applying the other features of the second consideration of the invention as well. In this respect, reference is made in full to the above description for the following embodiments as well, wherein concrete embodiment examples can also be found in the description of the figures.

In a third consideration of the invention, a multiple packaging made of a plurality of packagings connected to each other is provided, wherein the packagings are preferably according to the first or to the second consideration of the invention. It is further preferable that the multiple packaging comprises packagings both according to the first and according to the second consideration in combination. The multiple packaging particularly comprises packagings connected to each other in each of which one single cutting blade or at least two, preferably not more than four cutting blades are individually packaged.

The multiple packaging according to the third consideration of the invention comprises a continuous, substantially flat base layer made of a first packaging material, a continuous, substantially flat cover layer made of a second packaging material, the cover layer being disposed on a top side of the base layer and connected to the base layer at least in segments. The base layer and the cover layer implement a plurality of packagings disposed in a row along at least one first row direction, wherein a separation region is disposed between each of two packagings adjacent to each other in the first row direction. Each separation region runs transverse to the first row direction, at least in segments, and/or separates a first from a second packaging. Each separation region comprises a planned parting line disposed or implemented either in the base layer or in the cover layer. The separation region further comprises a hinge line in the other layer of the multiple packaging in which the planned parting line is not disposed.

The base layer and the cover layer of the multiple packaging are continuous, that is, the base layer and the cover layer each form a contiguous layer extending over the entire multiple packaging. This further means that the base layer and the cover layer of the multiple packaging each form the base layer and the cover layer of each individual packaging of the multiple packagings connected to each other for forming the multiple packaging.

The individual packagings from the plurality of packagings are disposed in a row in at least one first row direction. In a preferred embodiment, the multiple packaging thus forms a chain of individual packagings disposed successively in the first row direction. In a further preferred embodiment, the multiple packaging comprises a second row direction along which individual packagings are also disposed in a row. In this manner, the first and the second row directions implement a multiple packaging made of rows and columns of individual packagings. It must be understood that only one individual column or one individual row can also be provided.

The separation regions between each of two individual packagings adjacent to each other in a row direction subdivide the multiple packaging into individual segments in which the individual packagings are implemented. The planned parting line of each separation region thereby forms a line along which the layer in which said parting line is disposed can be separated. Said parting line preferably forms a separation and/or break point. The individual packagings can be broken or separated from each other at said separation and/or break point.

The planned parting line is preferably a marking along which the corresponding layer is to be cut apart by the user, for example by means of a knife or a scissors or simply by tearing. In a further preferred embodiment, the planned parting line is implemented by a weakening of the corresponding layer. In preferred embodiments, the weakening is thereby implemented in the form of a local notch and/or a tear line along at least one segment of the planned parting line. Such a tear line thereby weakens the layer in which said tear line is disposed along said line relative to adjacent regions of the layer, particularly such regions comprising no tear line. In preferred embodiment, the tear line is implemented as a partial or continuous perforation. Alternatively or in combination, the tear line is implemented as a regional reduction in the thickness of the corresponding layer. The tear line thus allows cutting apart the corresponding layer in which said tear line is implemented. The hinge line of each separation region is implemented such that when the corresponding layer is cut apart along the planned parting line, a rotational degree of freedom is produced between two packagings adjacent to each other along the separation region. A first adjacent packaging can thus be folded over relative to a second adjacent packaging. It can be advantageous to thus fold over a first packaging relative to the second packaging, such that the first packaging rests on the second packaging. The arrangement of individual packagings in a row, resulting in a predominantly flat extent of the multiple packaging, can thus be transformed into a stack of individual packagings in the manner of an accordion without completely breaking the connection between the individual packagings along a separation region. The hinge line can thereby be designed in any arbitrary manner able to provide a rotational degree of freedom. The hinge line can preferably be a fold line first introduced in the packaging material by folding over the packagings. In other words, it is preferable when an elasticity of the packaging material makes it possible that a line running parallel to the tear line functions as a hinge line as soon as the other layer in each case has been cut apart along the planned parting line, without the corresponding packaging material requiring any further processing along the hinge line. In other preferred 3*o* embodiments, the hinge line can also be implemented by a local weakening, for example by reducing the thickness of the corresponding layer. The separation regions can thereby take on any arbitrary contour, preferably adapted to the application, running transverse to the corresponding row direction at least in segments.

In a preferred embodiment of the multiple packaging according to the third consideration of the invention, the corresponding separation region is designed so that two adjacent packagings can be separated from each other, particularly tom off, along a planned parting line. In a further preferred embodiment, the base layer comprises a blade receptacle for each individual packaging. In a further preferred embodiment, the cover layer comprises a segment for each packaging forming a cover of the blade receptacle.

In a further preferred embodiment of the multiple packaging, the segment of the cover layer forming the cover is bounded by a second tear line at least in segments, so that the corresponding covers of the individual packagings can be removed from the cover layer in any arbitrary sequence. This is achieved particularly in that the first and the second tear lines are disposed spaced apart from each other, particularly so that said tear lines do not intersect. It can thus be made possible to advantageously remove cutting blades from the multiple packaging in any arbitrary sequence. In embodiments in which the individual packagings can be separated from each other along the planned parting line of the separation region, each cover of the corresponding individual packagings is thereby further removable regardless of whether the individual packaging is connected to an adjacent packaging or not. This can be advantageous because the user thereby obtains greater flexibility in the utilization of the packaging. For refinements and advantages of the blade receptacle and cover, reference is made to the description with respect to the first and to the second consideration of the invention and to the figure descriptions.

In a preferred embodiment of a packaging, optionally according to the first or to the second consideration, or of a multiple packaging according to the third consideration of the invention, a cutting blade is disposed in the blade receptacle in a retained manner.

The above disclosed refinements and features of the packaging according to the third consideration of the invention can be applied separately to all further considerations of the invention comprising identical or similar features and/or preferable refinements, without necessarily applying the other features of the third consideration of the invention as well. In this respect, reference is made in full to the above description for the following embodiments as well, wherein concrete embodiment examples can also be found in the description of the figures.

A fourth consideration of the invention relates to the use of a packaging of optionally the first or the second consideration, or a multiple packaging of the third consideration of the invention, for packaging ceramic blades. Particularly with respect to ceramic blades, the packagings and multiple packagings disclosed here are advantageous, as said packagings are made of cardboard and protect the blades and/or enable individual removal of the blade, so that synergetic effects can be achieved here.

In a fifth consideration of the invention, or a refinement of optionally the first, second, third, or fourth consideration of the invention, a method for packaging a cutting blade is provided. The method comprises providing a substantially flat base layer made of a first packaging material, providing a blade receptacle on or in the base layer, providing an individual cutting blade in the blade receptacle, and providing a substantially flat cover layer made of a second packaging material on a top side of the base layer. The method further comprises connecting the cover layer to the base layer at least in segments. A segment of the cover layer forms a cover of the blade receptacle. The first and second packaging material are preferably made primarily of cardboard. The method is particularly suitable for at least partially producing a packaging according to the first or second consideration or a multiple packaging according to the third consideration of the invention.

In a sixth consideration of the invention, or a refinement of optionally the first, second, third, fourth, or fifth consideration of the invention, a method for packaging a cutting blade is provided. The method comprises providing a substantially flat substrate, applying a substantially flat base layer to the substrate, providing a blade receptacle on or in the base layer, and providing a single cutting blade in the blade receptacle. The method further comprises folding a segment of the substrate along a connecting segment, wherein the folded segment of the substrate forms the cover layer, and attaching the cover layer at least in segments to a top side of the base layer. The method is particularly suitable for at least partially producing a packaging according to the first or second consideration or a multiple packaging according to the third consideration of the invention.

In a seventh consideration of the invention, or a refinement of optionally the first, second, third, fourth, fifth, or sixth consideration of the invention, a method for producing a multiple packaging is provided, preferably a multiple packaging according to the third consideration of the invention. The multiple packaging to be produced according to the method comprises a plurality of packagings connected to each other, preferably packagings for individually packaged products such as cutting blades, and particularly preferably packagings according to the first or to the second consideration of the invention. The method comprises providing a continuous, substantially flat base layer made of a first packaging material, providing a plurality of blade receptacles on or in the base layer and disposed in a row along at least one first row direction, providing a continuous, substantially flat cover layer made of a second packaging material on a top side of the base layer, connecting the cover layer to the base layer at least in segments, and providing or producing a separation region between two each of the blade receptacles adjacent to each other in the first row direction, each separation region running transverse to the row direction at least in segments. The method further comprises providing or producing each separation region by introducing a planned parting line either in the base layer and/or in the cover layer.

In a preferred embodiment, optionally of the fourth, fifth, or sixth consideration of the invention, the method further comprises applying a substantially flat substrate to the back side of the base layer. In a further preferred embodiment, the method further comprises folding a segment of the substrate along a connecting segment, wherein the folded segment of the substrate forms the cover layer. In a further preferred embodiment, the method comprises folding a segment of the substrate along a connecting segment, wherein the folded segment of the base layer forms the cover layer.

In a particularly preferred embodiment, optionally of the fourth, fifth, or sixth consideration of the invention, the method comprises folding a segment of the substrate along a first connecting segment, wherein the folded segment of the substrate forms the base layer, and further comprises folding a segment of the base layer thus formed along a second connecting segment, wherein the folded segment of the base layer forms the cover layer. The base layer, cover layer, and substrate of the packaging are thereby preferably provided from a single, contiguous, flat piece of the same packaging material by folding twice.

In a further preferred embodiment, optionally of the fourth, fifth, or sixth consideration of the invention, the method comprises folding a segment of the base layer along a connecting segment, wherein the folded segment of the base layer forms the cover layer. The packaging produced according to the present, preferred method does not necessarily comprise a substrate in this case.

In a further preferred embodiment, optionally of the fourth, fifth, or sixth consideration of the invention, the method further comprises introducing a second tear line in the cover layer, wherein the second tear line bounds, at least in segments, a region of the cover layer forming a cover of the blade receptacle.

With respect to the above explanations of the fourth, fifth, sixth, and seventh consideration of the invention, reference is made in full to the above description of the first, second, and third consideration of the invention, wherein concrete embodiment examples can also be found in the description of the figures.

Although the described considerations and refinement of the invention have each been disclosed with reference to packaging cutting blades, it is apparent that the devices and methods according to the invention can be used for packaging other products, particularly piece goods, for which separate packaging of each individual product and/or individually removing individually packaged products from a multiple packaging is particularly preferred.

Further features and advantages of all considerations of the invention arise from the attached claims and the figure description below, wherein particularly preferred embodiment examples of the packaging according to the invention for cutting blades and the multiple packaging according to the invention are explained in detail using the drawings.

Figure 1A:
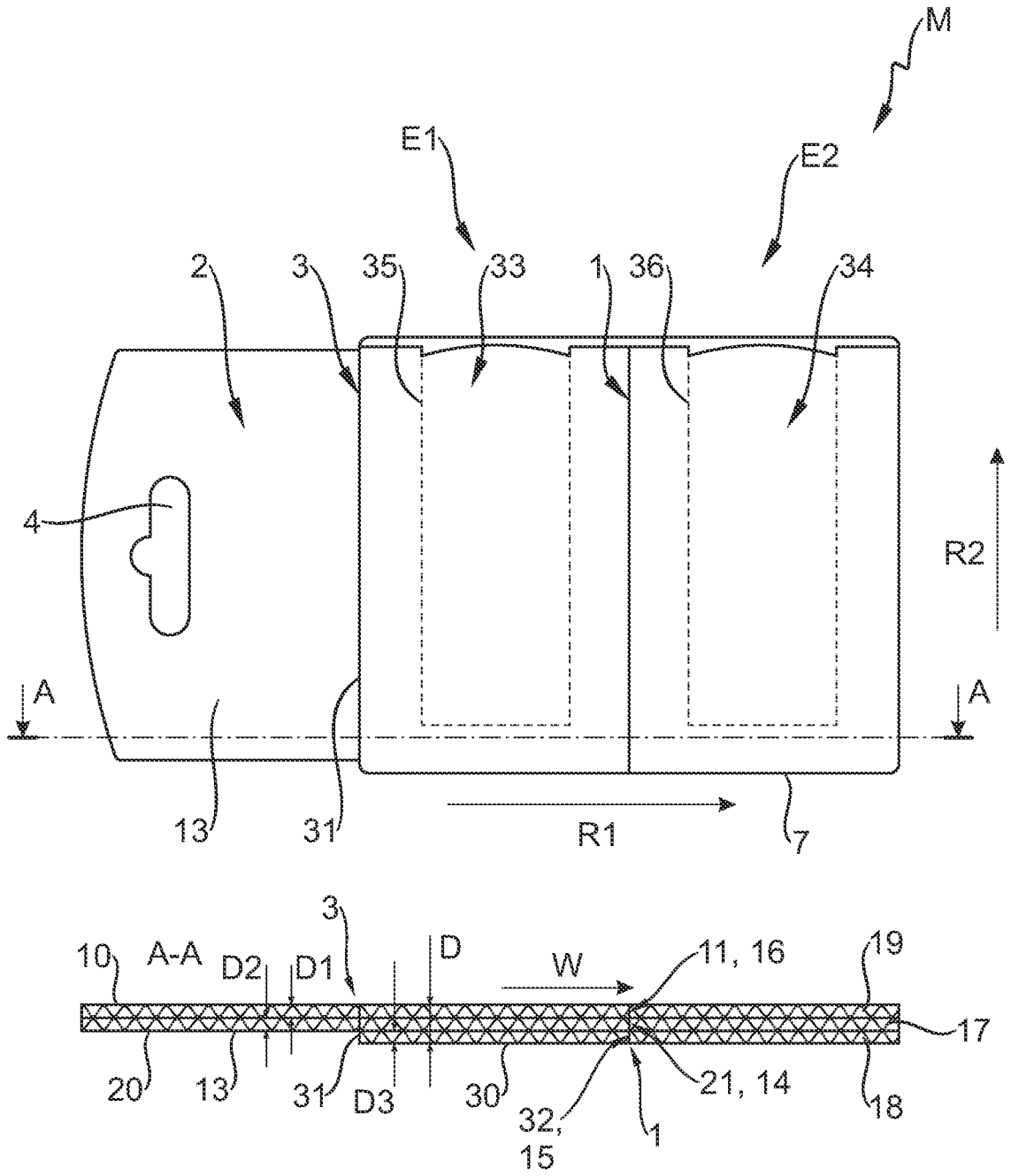
FIG. 1A shows a plan view of an embodiment example of a multiple packaging according to the invention comprising two individual packagings according to a further consideration of the invention disposed adjacent to each other in a row direction, and a section view along the line A-A.

According to the view in FIG. 1A, a multiple packaging M comprises a first individual packaging E1 and a second individual packaging E2 disposed in a row along a first row direction R1. The two individual packagings E1, E2 are adjacent to each other along a separation region 1 running perpendicular to the row direction R1 in the embodiment example shown. A tear-off region 2 is adjacent to the first individual packaging E1 opposite the row direction R1 and can be tom off from the individual packaging E1 along a perforation 3, and thus the entire rest of the multiple packaging M. A profiled cutout 4 is disposed in the tear-off region 2 and designed for hanging the entire multiple packaging M on a corresponding counterpart of a storage device (not shown). In the embodiment example shown, the profiled cutout 4 is implemented in the shape of a Euro perforation.

It should be understood that the multiple packaging M can comprise a second row direction R2 in further embodiments, not shown in the figures, along which individual packagings are also disposed in a row in addition to the first row direction R1. One such embodiment implements a multiple packaging M, for example, having a plurality of rows in a second row direction R1 of individual packagings disposed in a row in the first row direction R1. A pattern of rows and columns of individual packagings can thereby arise.

As shown in the section view A-A in FIG. 1A, the multiple packaging M is constructed of a plurality of layers. The section line A-A thereby runs at a short distance from an edge 7 of the multiple packaging M extend parallel to the row direction R1.

A substrate 10 forms the bottom layer of the multiple packaging M in the embodiment example shown, wherein a base layer 20 is disposed on the top side 12 of the substrate 10, and a cover layer 30 is disposed on the top side 13 of the base layer 20. In the embodiment example shown, the substrate 10 and the base layer 20 are congruent, so that the base layer 20 completely covers the substrate 10. The cover layer 30 further comprises a smaller extent in the direction of the first row direction R1. In the embodiment example shown, the substrate 10 and the base layer 20 form the tear-off region 2 in the region of the base layer 20 not covered by the cover layer 30. This means that the tear-off region 2 is formed exclusively by the substrate 10 and the base layer 20. The perforation 3 extends through the substrate 10 and the base layer 20, along an edge 31 of the cover layer 30 marking the beginning of the cover layer 30, transverse to the course of the first row direction R1. As can further be seen from the section view (FIG. 1A), the separation region 1 comprises a planned parting line 21 in the base layer 20, a planned parting line 32 in the cover layer 30, and a hinge line 11 in the substrate 10. The planned parting lines 21, 32 are implemented as the perforation 14 in the base layer and perforation 15 in the cover layer 30, while the hinge line 11 comprises a fold line 16 in the substrate 10.

In general, the base layer 20 is made of a first flat packaging material 17, the cover layer is made of a second flat packaging material 18, and the substrate 10 is made of a third flat packaging material 19. In the embodiment example shown in FIG. 1A, the first, the second, and the third packaging material 17, 18, 19 are each a corrugated cardboard, the corrugation direction W thereof running parallel to the first row direction R1. As can be seen in the section view (FIG. 1A), the corresponding first, second, and third thicknesses D1, D2, D3 of the substrate 10, the base layer 20, and the cover layer 30 are substantially smaller than the extents thereof in the plane shown by the plan view in which the flat layers also extend. All three layers 10, 20, 30 together have an overall thickness D in the assembled state (FIG. 1A), substantially corresponding to the sum of the first, second, and third thicknesses D1, D2, D3.

In the embodiment example shown in FIG. 1A, the first individual packaging E1 and the second individual packaging E2 are each implemented as rectangles of equal size, wherein the separation region 1 forms a common edge of a long side of each of the two rectangles. The format of each of the rectangles corresponds to that of a credit card.

Figure 1B:
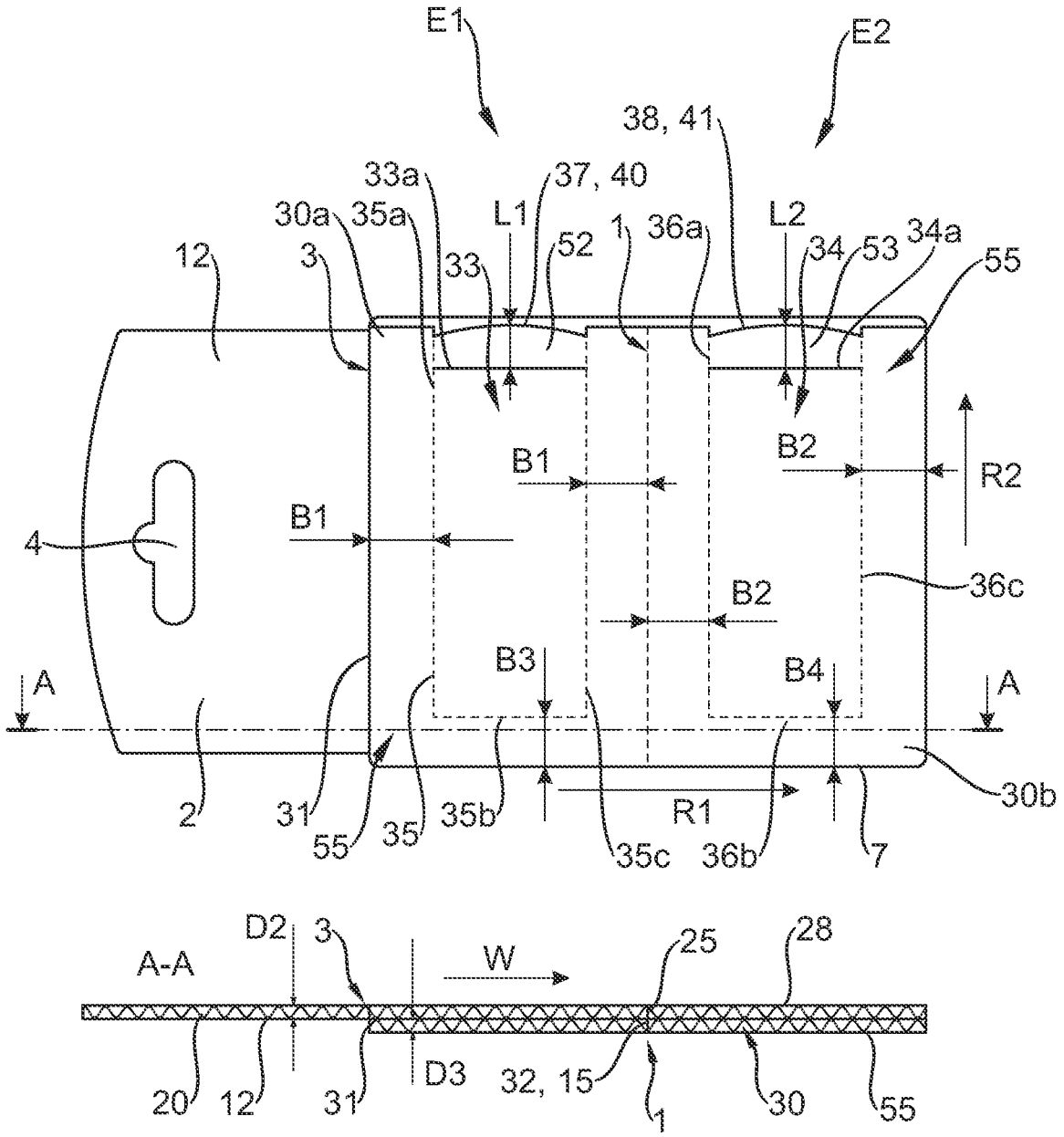
FIG. 1B shows a plan view of a further embodiment example of a multiple packaging according to the invention comprising two individual packagings according to a further consideration of the invention disposed adjacent to each other in a row direction, and a section view along the line A-A.

The embodiment example shown in FIG. 1B corresponds substantially to the embodiment example from FIG. 1A, wherein identical and similar elements are labeled with the same reference numerals as in FIG. 1A. In this respect, reference is made in full to the above description, and particularly the differences from the first embodiment example (FIG. 1A) are explained below. As is shown in the section view A-A of FIG. 1B, the multiple packaging M shown comprises only a base layer 20 and a cover layer 30. The perforation 3 therefore extends only through the base layer 20. The separation region 1 comprises a hinge line 25 in the base layer 20 and a tear line 32 in the cover layer 30.

Figure 2:
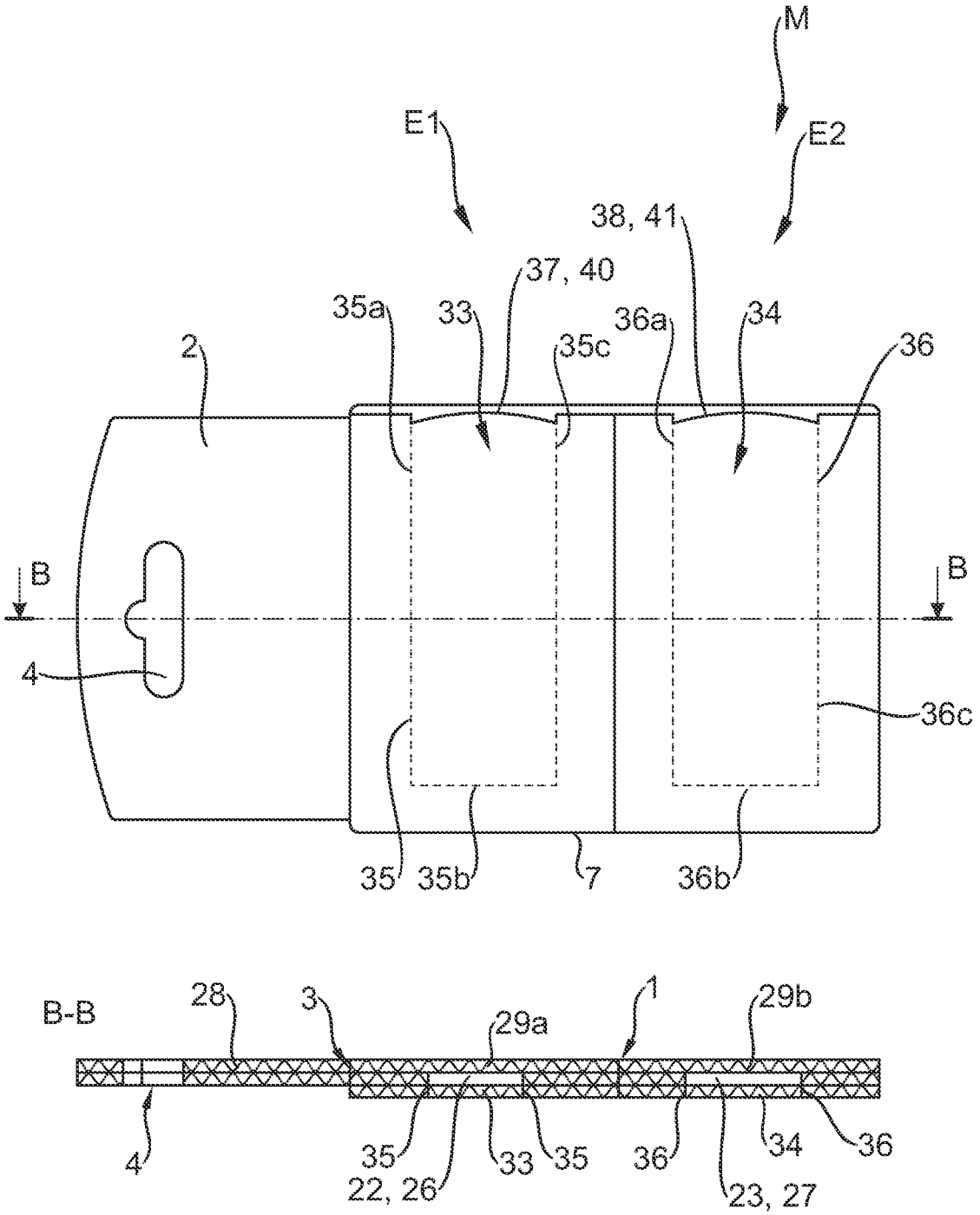
FIG. 2 shows a further plan view of the embodiment example from FIG. 1A and a further section view along the line B-B.

FIG. 2 shows a further plan view of the embodiment example from FIG. 1A and a section view along the line B-B substantially showing a centerline of the multiple packaging M. The base layer 20 comprises a first blade receptacle 22 in the region of the first packaging E1, and a second blade receptacle 23 in the region of the second packaging E2. In the embodiment example shown, the first blade receptacle 22 and the second blade receptacle 23 are each implemented as first and second hollow spaces 26, 27. The first and second hollow spaces 26, 27 are each formed by a pass-through opening extending from the top side 13 of the base layer 20 to the back side 28 thereof. A back wall 29*a*. 29*b* of each of the blade receptacles 22, 23 is formed by the substrate 10 in the present embodiment example. As shown in the section view in FIG. 2, the profiled cutout 4 extends as a pass-through opening through the base layer 20 and the substrate 10.

The blade receptacles 22, 23 are each covered by a segment of the cover layer 30 bounded from the cover layer 30 in the present embodiment examples (FIG. 1A through 6) by a first and second tear line 35, 36. The first and second tear lines 35, 36 are approximately U-shaped and run out of the cover layer 30 so that each cover 33, 34 also comprises an exposed edge 37, 38.

The first tear line 35 has a first tear line segment 35*a* here running perpendicular to the first row direction R1, and running on the side of the first cover 33 facing toward the tear-off segment 2, a second tear line segment 35*b* running parallel to the first row direction R1 on the side of the first cover 33 opposite the exposed edge 37, and a third tear line segment 35*c*, in turn running perpendicular to the first row direction R1, but running on the side of the first cover 33 facing away from the tear-off segment 2. The first tear line segment 35*a* and the third tear line segment 35*c* are implemented as perforations. The second tear line segment 35*b* is preferably implemented having a folding line, but can also be untreated. In a similar manner, the second tear line 36 has a fourth tear line segment 36*a* here running perpendicular to the first row direction R1, and running on the side of the second cover 34 facing toward the tear-off segment 2 or the separation region 1, a fifth tear line segment 36*b* running parallel to the first row direction R1 on the side of the second cover 34 opposite the exposed edge 38, and a sixth tear line segment 36*c*, in turn running perpendicular to the first row direction R1, but running on the side of the second cover 34 facing away from the tear-off segment 2 or the separation region 1. The fourth tear line segment 36*a* and the sixth tear line segment 36*c* are implemented as perforations. The fifth tear line segment 36*b* is preferably implemented having a folding line, but can also be untreated.

The tear line segments 35*a*, 35*c*, 36*a*, 36*c*, each perforated, extend through the entire thickness D3 of the cover layer 30. By separating along the perforated tear line segments 35*a*, 35*c*, 36*a*, 36*c*, the corresponding cover 33, 34 can be removed from the cover layer and the corresponding blade receptacle 22, 23 can thus be exposed. The corresponding cover 33, 34 is thereby preferably pivoted about the second or fifth tear line segment 35*b*, 36*b*. In the present embodiment example, the covers 33, 34 are disposed so that the exposed edge 37, 38 is disposed on a corresponding edge of a short side of the corresponding individual packaging E1, E2.

Alternatively, the second and fifth tear line segments 35*b*, 36*b* can also be implemented as perforations. By cutting off the corresponding tear line 35, 36, the corresponding cover 33, 34 in such an alternative embodiment example can thus be fully removed from the rest of the packaging.

One advantage arising from the fact that the covers 33, 34 each comprise an exposed edge 37, 38 disposed at an edge of the individual packagings E1, E2, can be that the covers 33, 34 can be removed independently of each other in an arbitrary sequence. The exposed edge 37, 38 in the present embodiment example has a curvature 40, 41 for facilitating a user grasping and removing the cover 33, 34.

If the multiple packaging M, as shown in FIG. 1B, comprises only a base layer 20 and a substrate 30, the blade receptacle 22, 23 of a single packaging E1, E2, is implemented as a groove-shaped recess or indentation (not shown) in the base layer 20, extending over only part of the thickness D2 of the base layer 20.

Figure 3:
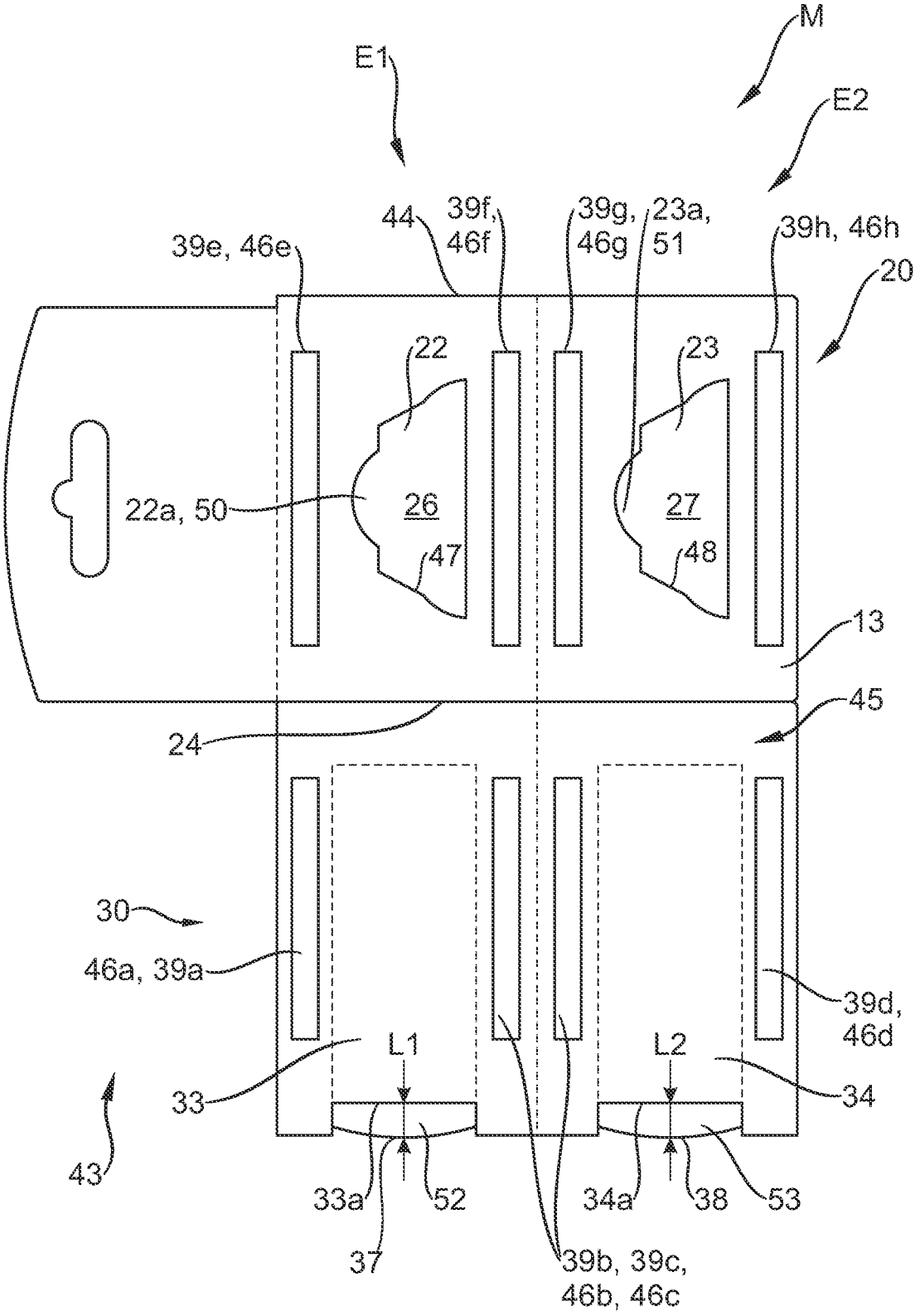
FIG. 3 shows a plan view of an embodiment example of a multiple packaging according to the invention according to FIGS. 1A and 1B, wherein a cover layer of the multiple packaging has been folded over in order to expose a base layer of the multiple packaging.

FIG. 3 shows a plan view of a multiple packaging M according to the preceding FIGS. 1A, 1B, and 2, wherein the cover layer 30 and the substrate 10 are made of a contiguous piece 43 of flat packaging material, that is, are implemented integrally. A connecting segment 24 subdivides, the contiguous piece 43 of flat packaging material into two segments forming the cover layer 30 and the substrate 10 of the multiple packaging M. In the depiction of FIG. 3, the cover layer 30 is shown folded away from the base layer 20 along the connecting segment 24, so that a view of the blade receptacle 22, 23 is exposed. For a multiple packaging M of the present embodiment, a substrate 10 and a cover layer 30 can thus be formed and layered one over the other by means of processing, that is, by cutting out a desired contour from a contiguous piece 43 of flat packaging material and subsequently folding along the connecting segment 24, wherein the base layer 20 is enclosed between the cover layer 30 and substrate 10 connected by means of a connecting segment 24.

In a further preferred embodiment of the present invention, a base layer 20 is further made of the same contiguous piece 43 of flat packaging material together with the cover layer 30 and the substrate 10. Such an embodiment comprises the first connecting segment 24 and a second connecting segment 44 in the flat piece of packaging material, together dividing the flat piece 43 of packaging material into three segment, correspondingly implementing the substrate 10, the cover layer 30, and the base layer 20 by folding along the corresponding connecting segments 24, 44. The first and second connecting segment 24, 44 are disposed at opposite ends of the substrate 10 and parallel to the first row direction R1. The segment forming the base layer 20 is first pivoted about the second connecting segment 44 for forming the multiple packaging M, so that the base layer 20 is disposed flat on the substrate 10, and then—after filling the blade receptacles 22, 23—the segment forming the cover layer 30 is pivoted about the first connecting segment 24, so that the cover layer 30 is disposed flat on the base layer 20 as described above. In an alternative embodiment, the cover layer 30 and the base layer 20 are integrally made of the same contiguous piece 43 of flat packaging material and connected by means of the connecting segment 24, while the substrate 10 is made of a separate, third packaging material 19.

For the case that the multiple packaging M has only two layers, namely the base layer 20 and the cover layer 30, said layers are preferably made of a flat piece 43 of packaging material, so that a connecting segment (not shown) is implemented between said layers.

FIG. 3 further shows how a connection between the base layer 20 and the cover layer can be produced for the embodiment shown and for all further embodiments of a packaging E1, E2. To this end, first through fourth connecting segments 39*a*, 39*b*, 39*c*, 39*d* (together referred to as 39) can be provided on the back side 45 of the cover layer 30 as shown. In the embodiment shown, said segments are preferably implemented as tape strips 46*a*, 46*b*, 46*c*, 46*d*. The connecting segments 39 in the embodiment shown are particularly disposed in a region of the cover layer 30 lying outside of a region of the covers 33, 34. It can thereby be prevented, for example, that the connection between the cover layer 30 and base layer 20 is unintentionally removed when removing one of the covers 33, 34. Alternatively or in addition, fifth through eighth connecting segments 39*e*, 39*f*, 39*g*, 39*h* are implemented on the top side 13 of the base layer 20 and are in turn implemented as tape strips 46*e*, 46*f*, 46*g*, 46*h*. The cover layer 30 can be adhered to the base layer 20 in this manner.

Figure 5:
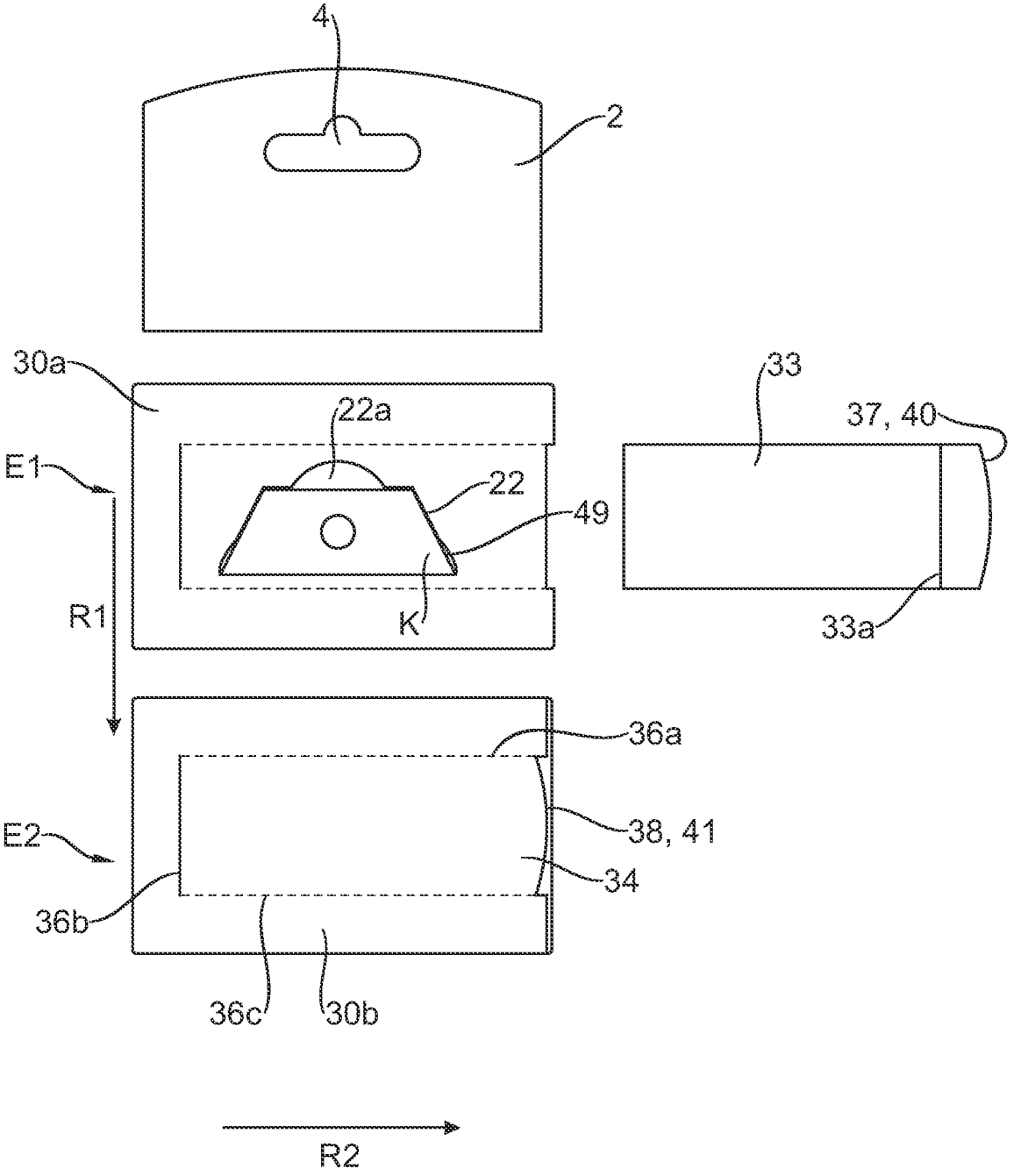
FIG. 5 shows a further plan view of the embodiment example from FIG. 4, wherein a cover of a blade receptacle of a first individual packaging is shown removed from the packaging and thus exposing the view of a cutting blade disposed in a blade receptacle.

FIG. 3 further shows that the blade receptacles 22, 23 in the present embodiment are implemented as first and second hollow spaces 26, 27 in the base layer 20 comprising an inner contour 47, 48 corresponding at least in segments to an outer contour (cf. FIG. 5) of a cutting blade K to be placed therein. An example of a trapezoidal cutting blade K received in a blade receptacle 22 implemented thusly is shown in FIG. 5. A segment 22A, 23A of the inner contour 47,48 of the blade receptacle 22, 23 can thereby be further spaced apart from the outer contour 49 of the cutting blade K in order to implement a clear handling region 50, 51. Said clear handling region 50, 51 can be adapted to a fingertip in shape and size in order to facilitate removing the cutting blade K It must be understood that the trapezoidal contour of the cutting blade K shown can be replaced by any arbitrary blade contour, such as rectangular, sickle-shaped, triangular, partially circular, etc., whereby the inner contour of an associated blade receptacle 22, 23 must also be adapted correspondingly. The pairing of the inner contour 47, 48, of the blade receptacle 22, 23 and the outer contour 49 of the cutting blade K can enable positively receiving the cutting blade K, whereby motion of the cutting blade K in the blade receptacle 22, 23 can be limited.

The first and second hollow spaces 26, 27 forming the blade receptacles 22, 23 as shown in FIG. 3, are preferably produced by punching out from the base layer 20.

The view of FIG. 3 further shows a preferred embodiment of the covers 33, 34, preferably each comprising a folding line 33A, 34A. The fold lines 33A, 34A are opposite the corresponding exposed edge 37, 38 of the cover 33, 34 and spaced apart so as to facilitate a user reaching a finger under the flap segment 52, 53 bounded by the exposed edge 36, 37 and the fold line 33A, 34A in order to lift and remove the cover 33, 34. The fold line 33A, 34A can thereby substantially serve as a hinge, so that the flap segment 52, 53 can be folded open about the fold line 33A, 34A relative to the rest of the cover 33, 34. In a preferred embodiment, a flap depth L1, L2 between the corresponding fold line 33A, 34A and the corresponding exposed edge 37, 38 is approximately 5 mm or greater, in a further preferred embodiment 7.5 mm or greater, and in a particularly preferred embodiment 10 mm or greater, each measured between the points of the fold line 33A, 34A and associated exposed edge 37, 38 spaced furthest apart and opposite each other.

Figure 4:
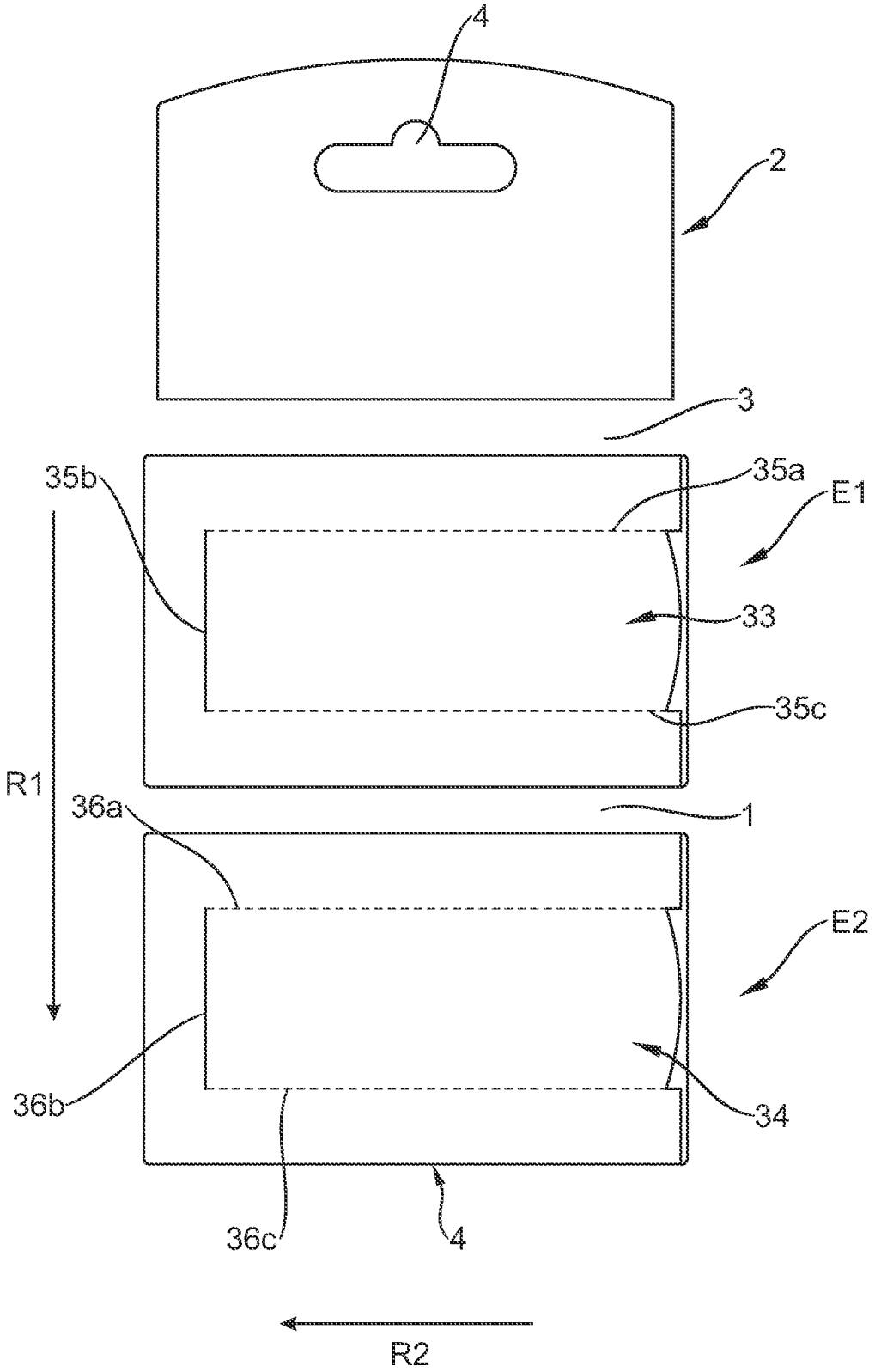
FIG. 4 shows a plan view of an embodiment example of the multiple packaging according to the invention according to FIGS. 1A, 1B, and 3, wherein the two individual packagings are separated from each other along a planned parting line of a separation region, and further a tear-off region is removed from the rest of the packaging.

FIG. 4 shows a plan view of an embodiment of a packaging E1, E2 according to FIGS. 1A, 1B, 2, and 3. For the embodiment shown, the separation region 1 is designed for separating between the two adjacent individual packagings E1, E2, so that one individual packaging E1, E2 can be removed from the multiple packaging M. It must be understood that in the present embodiment example, and in all other embodiments of a packaging E1, E2 according to the present invention, an arbitrary quantity of further individual packagings can be connected to the second individual packaging E2 in the first row direction R1.

The embodiment shown in FIG. 4 further shows how the tear-off region 2 is separated from the individual packaging E1 along the perforation 3. It must be understood that a packaging E1, E2 and a multiple packaging M according to the present invention can also be implemented without a tear-off region 2. It must further be understood that an individual packaging E1, E2 according to any one of the embodiments shown can also be produced separately and as such can be used for packaging a cutting blade K.

FIG. 5 shows the embodiment shown in FIG. 4, wherein the cover 33 of the individual packaging E1 has been removed from the cover layer 30, whereby the view of a cutting blade K received in the blade receptacle 22 is exposed.

Figure 6:
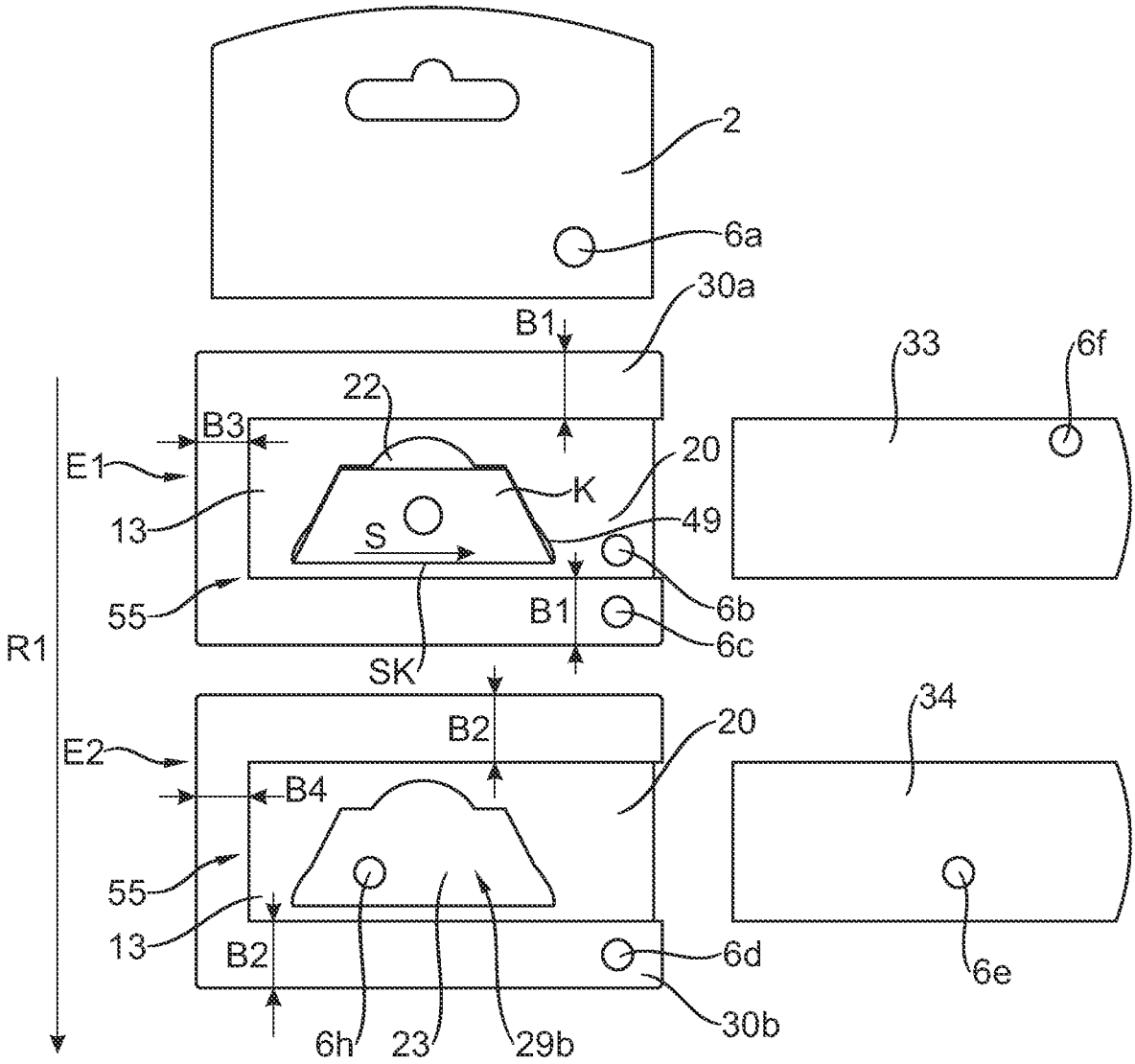
FIG. 6 shows a further plan view of the embodiment example from FIG. 4, wherein, as in FIG. 5, the cover of a blade receptacle of a first individual packaging is shown removed from the packaging, and further the cover of a blade receptacle of a second individual packaging is shown removed from the packaging, wherein the second blade receptacle is free of a cutting blade.

FIG. 6 shows the embodiment shown in FIG. 4 and FIG. 5, wherein the cover 34 of the second individual packaging E2 is further shown removed from the blade receptacle 23, wherein the blade receptacle 23 is shown free of a cutting blade K. FIG. 6 further shows potential locations for applying markings 6A-H, particularly imprints. Such markings 6A-H are applied in the embodiment shown on the tear-off region 2, a back side of the covers 33, 34, a top side 55 of the cover layer 30, a back wall 29*a*, 29*b* of the blade receptacle 23, and in a region of the top side 13 of the base layer 20 exposed by removing the covers 33, 34. It must be understood that each of the markings 6A-H can be applied in isolation or in any arbitrary combination with the other markings 6A-H. The markings 6A-H can particularly be present in every embodiment of a packaging E1, E2 according to the present invention. The markings 6A-H particularly are warning notices, information about the product present in the packaging E1, E2, particularly the dimensions thereof, and/or instructions for handling the packaging.

As is shown in FIG. 5 and FIG. 6, for example, a segment 30A, 30B of the cover layer remains on the base layer 20 after removing the cover 33, 34. In the embodiments shown, the segment 30A, 30B is substantially C-shaped in design. In a preferred embodiment, the width B1, B2 of such a segment 30A, 30B along the first row direction R1 is approximately 5 mm or greater, 7.5 mm or greater, and in a particularly preferred embodiment 10 mm and greater. The same applies for a width B3, B4 perpendicular to the first row direction R1. It can thereby be achieved, for example, that a spacing between a tear line 35, 36 and the separation region 10 is sufficient for preventing a removal along one of the tear lines 35, 36 from resulting in an unintended removal along the other tear line 35, 36. It can thereby also be made possible that removing the covers 33, 34 can be done independently of whether the packagings E1, E2 are connected or separated along the separation region 1. It can also be thereby achieved, for example, that the remaining segment 30A, 30B further contributes to the flexural rigidity of the packaging E1, E2. Such flexural rigidity can be further desired after removing the cover 33, 34, for example, in order to be able to replace a cutting blade K back in the blade receptacle 22, 23 after removing.

FIG. 6 further shows how the contour 47 of the blade receptacle 22 receives the cutting blade K so that a cutting edge SK of the cutting blade K is disposed substantially parallel to a blade orientation S specified by the blade receptacle 22. In preferred embodiments, the blade receptacle 22 is oriented so that the blade orientation S is oriented at a desired angle to the corrugation direction W of the corrugated cardboard used as packaging material 17, 18, 19. Because the corrugated cardboard has a lower flexural rigidity along the corrugation direction W than transverse to the corrugation direction W, the bending behavior of the individual packaging E1, E2 and of the entire multiple packaging M can be adapted to the requirements for handling, transport, and storage of the cutting blade K. It must thereby be understood that a directional flexural rigidity of the package E1, E2 can be achieved in any desired manner, particularly also by using other anisotropic packaging materials instead of corrugated cardboard.

It must further be understood that the embodiments shown in the figures can be combined arbitrarily with the similar or identical features and refinements of the considerations 1-7 of the invention described above. Reference is made in full the considerations 1-7 with respect to the same and to further alternatives and embodiments, and to the advantages thereof.

The invention claimed is:

1. A multiple packaging made of a plurality of individual packagings for cutting blades connected to each other, the multiple packaging comprising:
- a continuous, substantially flat base layer made of a first packaging material;
- a continuous, substantially flat cover layer made of a second packaging material;
- the cover layer being disposed on a top side of the base layer and connected to the base layer at least in segments; and
- the base layer and the cover layer implementing a plurality of packagings disposed in a row along at least one first row direction;
- wherein a separation region is implemented between two each of the packagings adjacent to each other in the first row direction for dividing the first from the second packaging;
- wherein each separation region comprises a first planned parting line either in the base layer or in the cover layer, wherein the separation region comprises a hinge line in the other layer of the multiple packaging;
- wherein each of the packagings comprises a blade receptacle designed for receiving a single cutting blade, the receptacle formed in the base layer;
- wherein each of the packagings comprises a cover of the blade receptacle formed by a partial segment of the cover layer, the cover being releasable in order to expose a single cutting blade received by the blade receptacle;
- wherein the first and second packaging material are made primarily of cardboard; and
- a continuous, substantially flat substrate made of a third packaging material disposed on the back side of the base layer;
- a second planned parting line in the substrate disposed in the parting region and defining a separation and/or break point.

2. The multiple packaging according to claim 1, wherein the blade receptacle is designed for limiting, at least in a plane parallel to the base layer, a motion of a single cutting blade received by the blade receptacle.

3. The multiple packaging according to claim 1, wherein:
- the blade receptacle is designed for receiving a cutting blade such that a cutting edge of a received cutting blade comprises a blade orientation specified by the blade receptacle;
- the first packaging material comprises at least one first rigidity along a first primary material direction and a second rigidity along a second primary material direction; and the base layer and/or the cover layer are disposed so that the first primary material direction is aligned parallel to the blade orientation;
- and/or
- the second packaging material comprises at least one third rigidity along a third primary material direction and a fourth rigidity along a fourth primary material direction; and the base layer and/or the cover layer are disposed so that the third primary material direction is aligned parallel to the blade orientation.

4. The multiple packaging according to claim 3, wherein the first and/or the second packaging material is corrugated cardboard and a corrugation direction of the corrugated cardboard corresponds to the first primary material direction and/or to the third primary material direction.

5. The multiple packaging according to claim 1, wherein the blade receptacle of each packaging is implemented by a recess in the base layer.

6. The multiple packaging according to claim 5, wherein an inner contour of the recess corresponds at least in segments to an outer contour of the individual cutting blade.

7. The multiple packaging according to claim 1, further comprising a substantially flat substrate made of a third packaging material applied to the back side of the base layer.

8. The multiple packaging according to claim 7, wherein:
- a pass-through opening extending from the top side of the base layer to a back side of the base layer forms a part of the blade receptacle; and
- the substrate forms a back wall of the blade receptacle.

9. The multiple packaging according to claim 7, wherein the third packaging material is made primarily of cardboard.

10. The multiple packaging according to claim 1, further comprising for each packaging:
- a tear-off region disposed in the base layer and/or in the cover layer and/or in the substrate for tearing off from the rest of the packaging along a perforation;
- a profiled cutout disposed in the tear-off region and designed for hanging the packaging on a corresponding counterpart of a storage facility.

11. The multiple packaging according to claim 7, wherein the substrate and the base layer are integral in design and connected to each other by means of an intermediate segment.

12. The multiple packaging according to claim 1, wherein the substrate and the cover layer are integral in design and connected to each other by means of an intermediate segment.

13. The multiple packaging according to claim 1, further comprising for each packaging a tear line bounding the segment of the cover layer forming the cover at least in segments.

14. The multiple packaging according to claim 1, wherein a back side of the cover layer and the top side of the base layer are connected to each other at least at a connecting segment, wherein the at least one connecting segment is disposed in a region of the cover layer outside of the cover.

15. The multiple packaging according to claim 1, wherein the cover layer for each packaging further comprises a second tear line bounding, at least in segments, the segment forming the cover, so that the corresponding covers of the packagings can be released from the cover layer in an arbitrary sequence along a corresponding second tear line.

16. The multiple packaging according to claim 1, each packaging further comprising a cutting blade disposed in the blade receptacle in a captive manner.

17. A use of a multiple packaging according to claim 1 for packaging ceramic blades.

* * * * *